US006807393B2

(12) United States Patent
Sameshima et al.

(10) Patent No.: US 6,807,393 B2
(45) Date of Patent: Oct. 19, 2004

(54) IMAGE FORMING UNIT AND IMAGE FORMING APPARATUS

(75) Inventors: Takao Sameshima, Shizuoka-ken (JP); Mitsugu Inomata, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/238,777

(22) Filed: Sep. 11, 2002

(65) Prior Publication Data

US 2003/0012582 A1 Jan. 16, 2003

Related U.S. Application Data

(63) Continuation of application No. 09/793,096, filed on Feb. 27, 2001, now Pat. No. 6,493,528.

(30) Foreign Application Priority Data

Mar. 3, 2000 (JP) ..... 2000-058678
Mar. 3, 2000 (JP) ..... 2000-058679

(51) Int. Cl.[7] ..... G03G 21/18
(52) U.S. Cl. ..... 399/113; 399/111
(58) Field of Search ..... 399/107, 110, 399/111, 113, 116, 121

(56) References Cited

U.S. PATENT DOCUMENTS 5,235,383 A 8/1993 Tada et al.
5,276,479 A 1/1994 Inomata
5,323,210 A 6/1994 Inomata et al.
5,440,373 A 8/1995 Deki et al. ..... 399/113
5,497,220 A 3/1996 Inomata et al.
5,521,693 A 5/1996 Kojima et al.
5,587,769 A 12/1996 Sawada et al. ..... 399/113
5,729,809 A 3/1998 Haneda et al. ..... 399/308
5,797,069 A 8/1998 Kimura et al. ..... 399/113
5,802,427 A 9/1998 Sawada et al. ..... 399/122
5,809,373 A 9/1998 Yoda et al. ..... 399/101
5,983,062 A 11/1999 Sameshima ..... 399/302
6,081,676 A 6/2000 Inomata et al. ..... 399/25

FOREIGN PATENT DOCUMENTS

JP 8-137181 5/1996
JP 10-177329 6/1998
JP 11-52759 2/1999
JP 11-309944 11/1999

*Primary Examiner*—Sandra L. Brase
(74) *Attorney, Agent, or Firm*—Fitzpatrick, Cella, Harper & Scinto

(57) ABSTRACT

An image forming unit is detachably mountable to a main body of an image forming apparatus and includes a first unit including an image bearing member, and a second unit including an intermediate transfer member to which is transferred a toner image on the image bearing member. The toner image on the intermediate transfer member is transferred to a recording material, and at least either of the first and second units is detachable from and attachable to the image forming unit.

46 Claims, 15 Drawing Sheets

IMAGE FORMING UNIT AND IMAGE FORMING APPARATUS

CROSS REFERENCE TO RELATED APPLICATION

This application is a continuation of application Ser. No. 09/793,096 filed Feb. 27, 2001, now U.S. Pat. No. 6,493, 528.

BACKGROUND OF THE INVENTION

1. Field of the Invention

The present invention relates to an image forming apparatus utilizing the electrophotographic process and an image forming unit adapted for use therein, and more particularly to an image forming apparatus such as a copying machine, a printer or a facsimile and an image forming unit adapted for use in the image forming apparatus.

2. Related Background Art

In an electrophotographic image forming apparatus, the image is formed by transferring, onto a recording material, a toner image formed on a photosensitive drum as an image bearing member, and, in a color image forming apparatus, there has been employed a configuration of transferring toner images of different colors, formed sequentially on the photosensitive drum, superimposing the toner images on an intermediate transfer member and collectively transferring such color images onto the recording material. In such configuration, in order to facilitate replacement of the deteriorated photosensitive drum and the consumed materials, there is widely adopted a configuration in which these components are formed as a unit detachably mountable to the main body of the apparatus.

For example, in an apparatus disclosed in the Japanese Patent Application Laid-open No. 8-137181 (hereinafter referred to as a "first conventional apparatus"), a photosensitive member unit and an intermediate transfer member unit are respectively constructed as independent units, and the apparatus is so constructed that a large movable frame opens by rotation to the front side of the apparatus and that the photosensitive member unit and the intermediate transfer member unit are respectively inserted from above.

Above the intermediate transfer belt, there is provided the photosensitive member unit integrally containing the photosensitive drum and a waste toner containing box, whereby the waste toner on the photosensitive drum is scraped off by a cleaning blade and is collected in the waste toner containing box at the back. Also the waste toner on the intermediate transfer belt is scraped off by another cleaning blade, then conveyed by a conveying coil to a position under a first conveying pipe, and is in turn conveyed by a screw in the first conveying pipe to a position above the waste toner containing box. Thereafter it is conveyed by a conveying coil in a second conveying pipe and is finally collected in the waste toner containing box.

The connecting part of the second pipe and the waste toner containing box belonging to separate units can be disconnected so that a shutter is opened and closed on connecting and disconnecting in order to prevent leaking of the waste toner.

In another example of the conventional color image forming apparatus (hereinafter referred to as a "second conventional apparatus"), as disclosed in the Japanese Patent Applications Laid-open Nos. 11-30944 and 10-177329, there is proposed a configuration in which a photosensitive belt, an intermediate transfer belt and a waste toner containing box are integrally included.

In the second conventional apparatus, the photosensitive belt and the waste toner containing box are provided under the intermediate transfer belt. Also, as in the first conventional apparatus, there is employed a configuration in which a large movable frame opens by rotation to the front side of the apparatus and that an image forming unit integrally including an intermediate transfer member, a photosensitive member and a waste toner containing box is inserted from above.

However, the conventional color forming apparatus described above is associated with the following drawbacks.

In the first conventional apparatus, the intermediate transfer member and the photosensitive member are formed as separate units, and the presence of such two units results in a larger number of steps in the replacing operation by the user. The usability is also deteriorated by the leakage of the waste toner from the connecting portion for the waste toner between the units and by the inserting and extracting operations required at the mounting and detaching of the units.

Also there is required a large aperture for mounting and detaching the image forming units of two kinds. For this reason, there is adopted a configuration in which the entire front face of the apparatus opens by rotation, and such configuration imposes heavy work on the user despite of the presence of a damper mechanism, requiring a large space and a high rigidity of the frame for the rotating mechanism and also requiring a high cost.

Also in the second conventional apparatus, the photosensitive belt, the intermediate transfer belt and the waste toner containing box are integrally constructed as an image forming unit, which can be replaced by the user upon reaching the end of a predetermined service life. However, the photosensitive belt and the intermediate transfer belt have to be replaced when either reaches the end of its service life, even if the other is still usable, whereby a burden of a higher cost is imposed on the user.

SUMMARY OF THE INVENTION

In consideration of the foregoing, an object of the present invention is to provide an image forming unit capable of improving the usability and an image forming apparatus utilizing such image forming unit.

Another object of the present invention is to provide an image forming unit capable of achieving compactization and cost reduction, and an image forming apparatus utilizing such image forming unit.

Still other objects of the present invention, and the features thereof, will become fully apparent from the following detailed description.

DESCRIPTION OF THE PREFERRED EMBODIMENTS

In the following there will be explained, with reference to accompanying drawings, an image forming unit and an image forming apparatus according to an embodiment of the present invention.

First Embodiment

Figure 1:
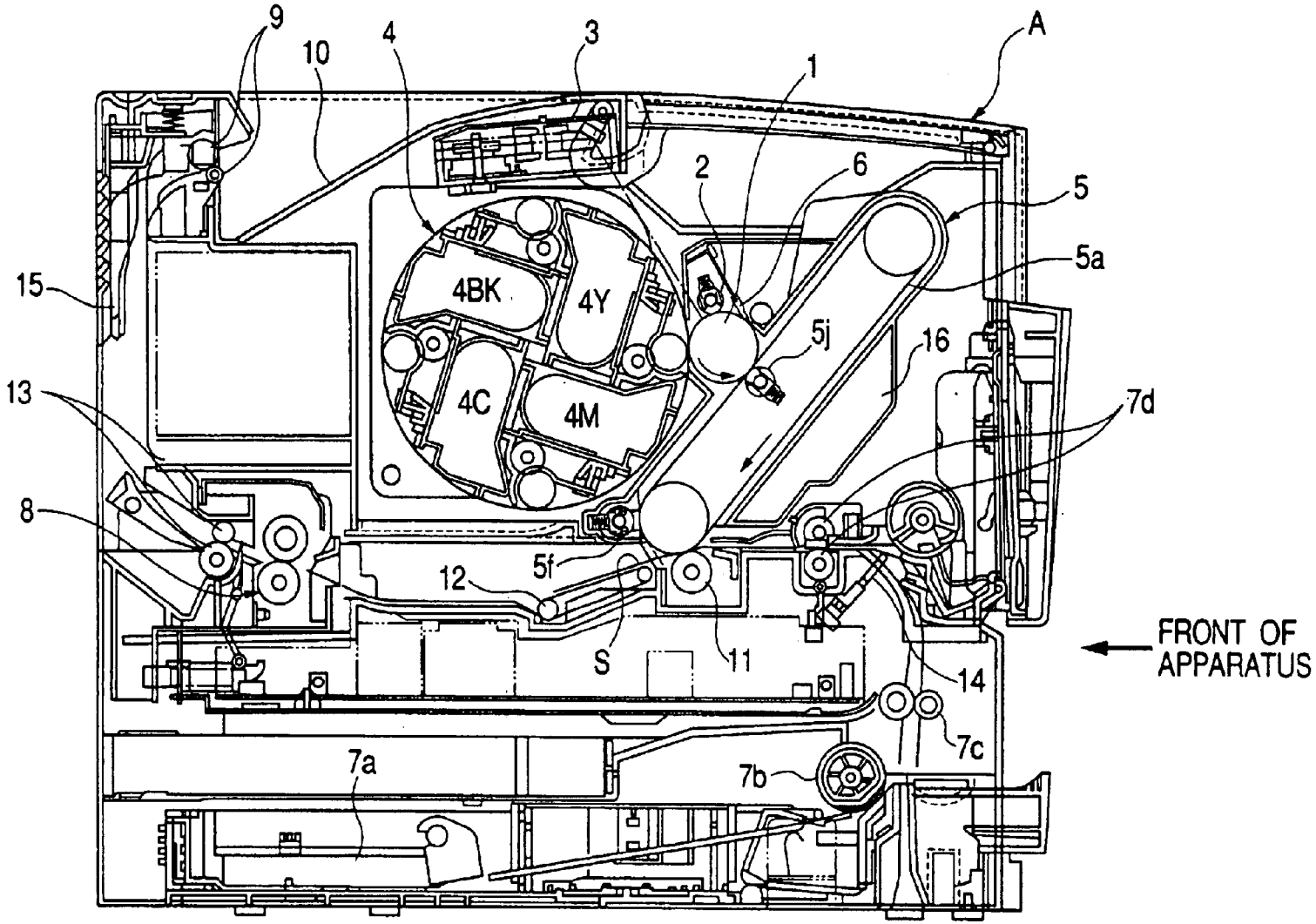
FIG. 1 is a longitudinal cross-sectional view showing the configuration of a full-color (4-color) laser beam printer.

FIG. 1 is a longitudinal cross-sectional view schematically showing the configuration of a full-color (4-color) laser beam printer as an electrophotographic image forming apparatus A according to the first embodiment of the present invention.

Entire Configuration of Image Forming Apparatus

In synchronism with the rotation of an intermediate transfer belt 5*a* as an intermediate transfer member and formed in the shape of an endless belt, a photosensitive drum 1 as an image bearing member is rotated in a direction (counterclockwise) indicated by an arrow in FIG. 1. The surface of the photosensitive drum 1 is uniformly charged by a charging roller 2 as a charging device and is exposed with a light corresponding to a yellow image by exposure means 3, thereby forming an electrostatic latent image of the yellow color image on the photosensitive drum 1. Simultaneous with the formation of such electrostatic latent image, a developing apparatus 4 is driven to position a yellow developing device 4Y in a developing position, and, in order to deposit yellow toner on the electrostatic latent image on the photosensitive drum 1, a voltage with the same polarity as the charging polarity of the photosensitive drum 1 and with the approximately same potential as that of the latent image is applied to the developing device, thereby developing the electrostatic latent image by yellow toner deposition. Thereafter a voltage of a polarity opposite to that of the toner is applied to a pressure roller (primary transfer roller) 5*j* for the intermediate transfer belt 5*a*, thereby executing primary transfer of the yellow toner image from the photosensitive drum 1 onto the intermediate transfer belt 5*a*.

After the primary transfer of the yellow toner image as explained in the foregoing, a next developing device is moved by rotation and is placed in the developing position opposed to the photosensitive drum. Then, in a similar manner as in the case of yellow color, there are executed sequentially for each of magenta, cyan and black colors, the formation of an electrostatic latent image, development with a developing device 4M, 4C or 4BK of respective color, and a primary transfer, whereby the toner images of four colors are superimposed on the intermediate transfer belt 5*a*.

During these operations, a secondary transfer roller 11 is out of contact with the intermediate transfer belt 5*a*. Also a charging roller 5*f* as cleaning charging means is out of contact with the intermediate transfer belt 5*a*.

After the formation of toner images of four colors on the intermediate transfer belt 5*a*, the secondary transfer roller 11 is brought into pressure contact with the intermediate transfer belt 5*a* (state shown in FIG. 1), and a recording material, conveyed by a feed roller 7*b* and paired conveying rollers 7*c* as conveying means and waiting in a predetermined position in the vicinity of paired registration rollers 7*d*, is advanced to the nip between the intermediate transfer belt 5*a* and the secondary transfer roller 11 in synchronism with the rotation of the intermediate transfer belt 5*a*.

Immediately in front of the paired registration rollers 7*d*, there is provided an ante-registration sensor 14 for detecting the leading end of the recording material S, thereby terminating the rotation of the paired registration rollers 7*d* and causing the recording material S to wait in the predetermined position.

Also, the secondary transfer roller 11 is applied a voltage of a polarity opposite to that of the toner, whereby the toner images on the intermediate transfer belt 5*a* are collectively secondary-transferred onto the surface of the conveyed recording material S.

The recording material S having been subjected to the secondary transfer then reaches, through a conveyor belt unit 12, a fixing device 8 for fixing the toner images of plural colors, and is then conveyed along a discharge guide 15 by paired discharge rollers 13 and is discharged by paired discharge rollers 9 onto a discharge tray 10 in the upper part of the color image forming apparatus A, whereupon the image formation operation is completed.

On the other hand, after the secondary transfer, a cleaning charging roller 5*f* is brought into pressure contact with the intermediate transfer belt 5*a*, and applies, to the toner remaining on the intermediate transfer belt 5*a*, a charge of a polarity opposite to that at the transfer (namely a charge of a polarity opposite to the normal charging polarity of the toner) thereby collecting the remaining toner. In this collecting means, the remaining toner provided with the charge of the opposite polarity as explained above sticks to the photosensitive drum 1 by the primary transfer roller 5*j*, and is thereafter collected by a cleaning blade 6 for the photosensitive drum. The collected remaining toner is conveyed along a conveying path for the waste toner, to be explained later, and is collected and accumulated in the waste toner containing box 16.

In the case of continuous image formation on plural recording materials, simultaneous with the electrostatic transfer of the remaining toner charged by the cleaning charging roller 5*f* from the intermediate transfer belt 5*a* to the photosensitive drum 1, a toner image formed on the photosensitive drum 1 for a succeeding recording material is primary transferred onto the intermediate transfer belt 5*a*. In this manner it is rendered possible to improve the throughput of image formation.

Image Forming Unit

In the following there will be explained, in detail, the configuration of the image forming unit 5 to be detachably mounted on the aforementioned image forming apparatus A and integrally including the photosensitive drum 1 and the intermediate transfer belt 5*a*.

Figure 2:
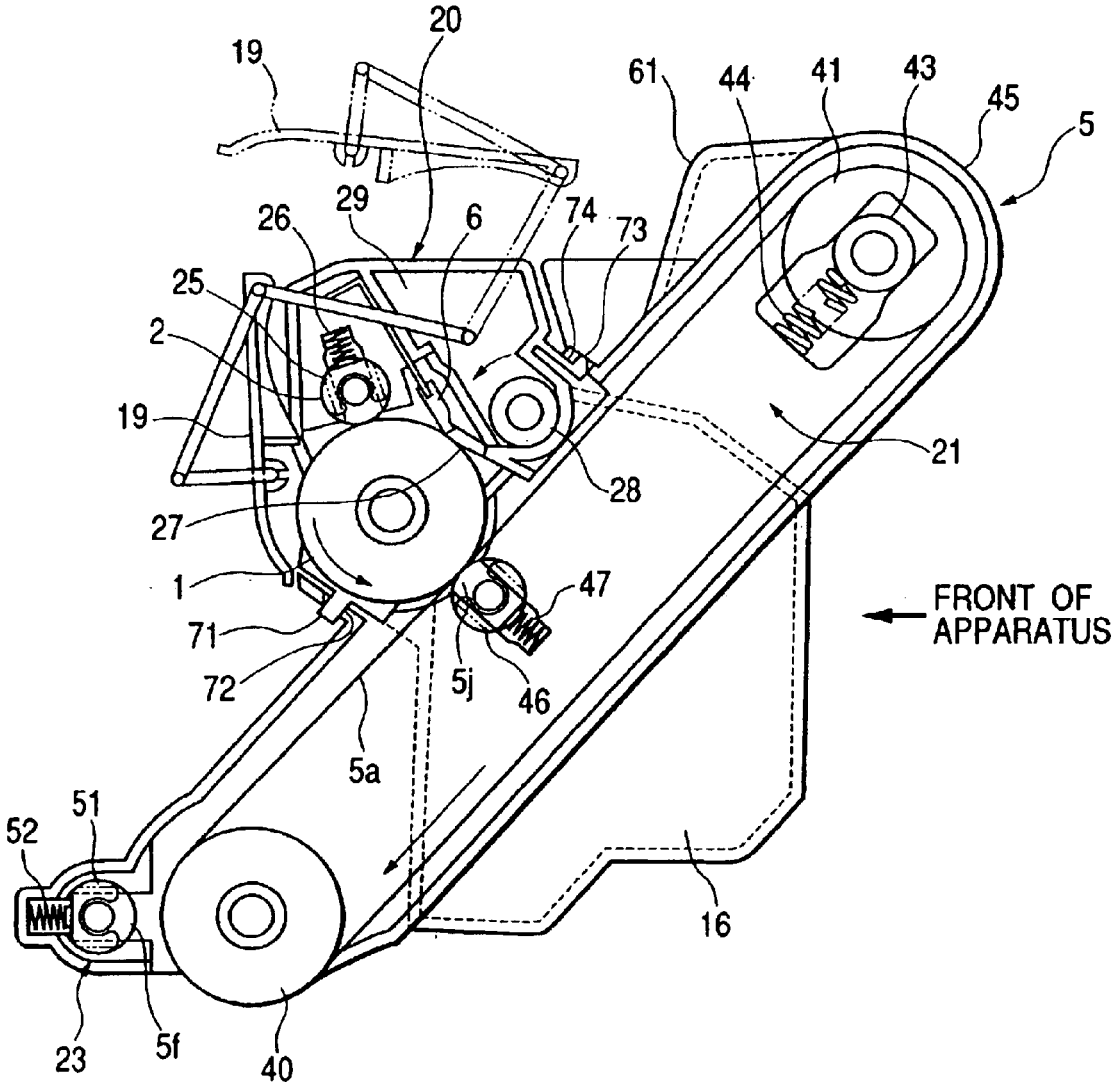
FIG. 2 is a longitudinal cross-sectional view showing the configuration of an image forming unit.
Figure 3:
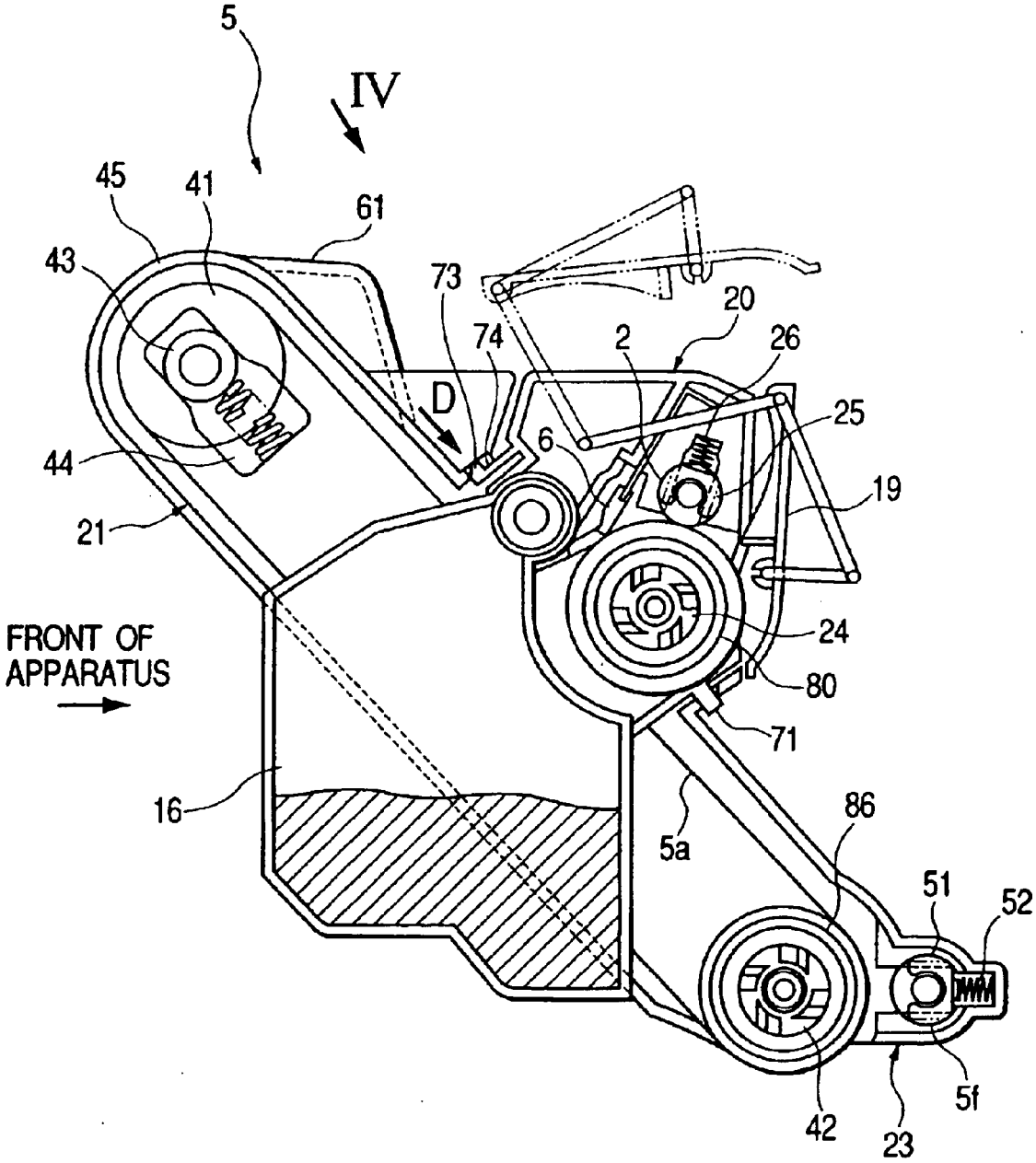
FIG. 3 is a longitudinal cross-sectional view of the image forming unit seen from a direction opposite to that of FIG. 2.
Figure 4:
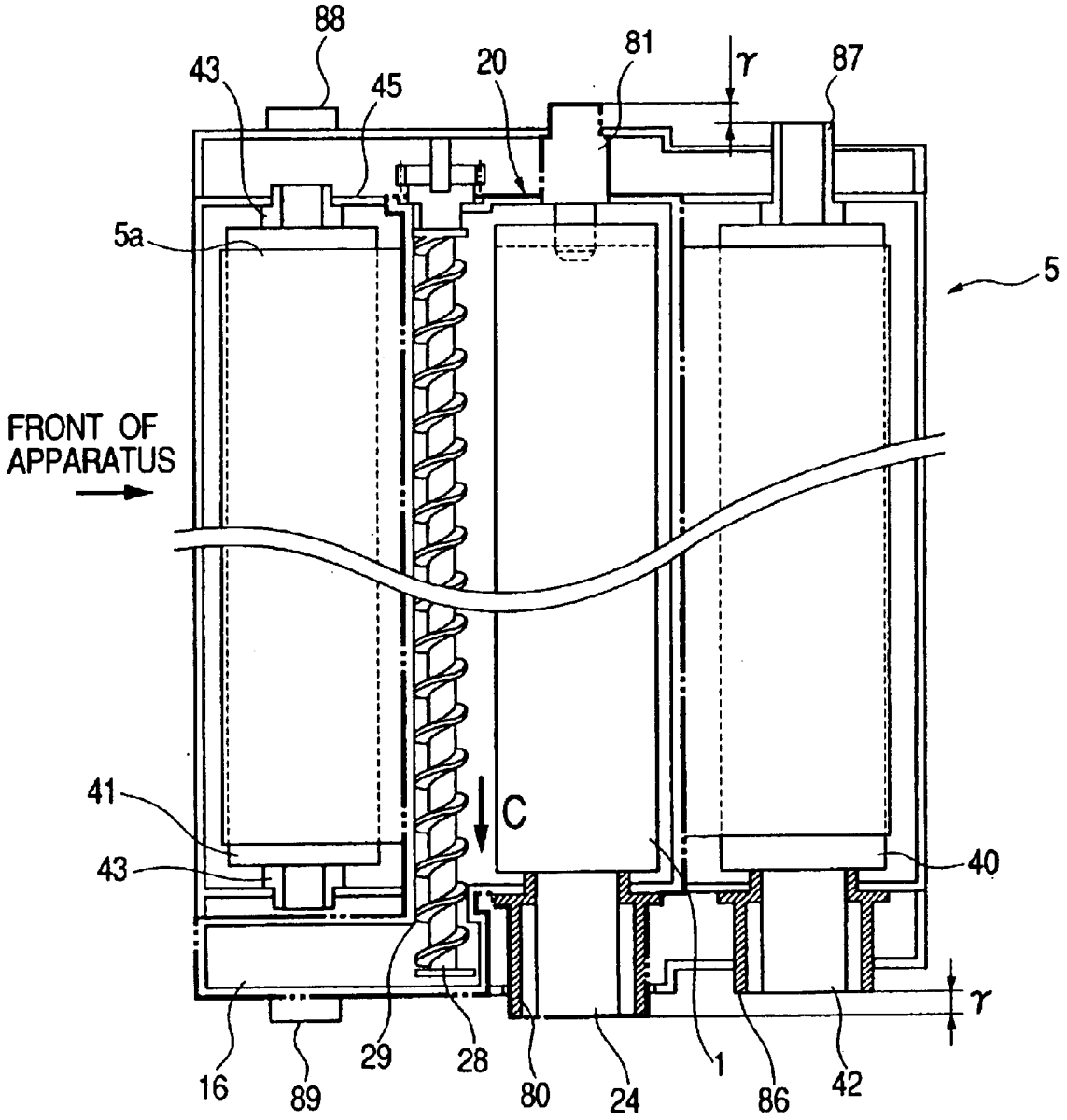
FIG. 4 is a transversal cross-sectional view of a waste toner conveying path, seen from a direction indicated by the arrow IV in FIG. 3.

FIG. 2 is a longitudinal cross-sectional view schematically showing the configuration of the image forming unit 5, while FIG. 3 is a longitudinal cross-sectional view of the image forming unit 5 seen from a direction opposite to that of FIG. 2, and FIG. 4 is a transversal cross-sectional view of a waste toner conveying path seen from a direction indicated by the arrow IV in FIG. 3.

Referring to FIGS. 2 to 4, the image forming unit 5 is provided with a photosensitive drum unit 20 and a waster toner containing box 16 respectively in an upper project plane and a lower project plane of an intermediate transfer belt unit 21. Also, a belt driving roller 40 of the intermediate transfer belt unit 21 is integrally provided with a cleaning charging roller unit 23 for inducing a charge of a polarity opposite to that at the transfer to the remaining toner on the intermediate transfer belt.

In the photosensitive drum unit 20, the photosensitive drum 1 is rotatably supported at both ends thereof by unrepresented bearings, and receives a predetermined rotary driving force from the main body of the apparatus, through a coupling 24 (cf. FIG. 3) at the right-hand end.

With the photosensitive drum 1, the charging roller 2 is brought into pressure contact, through bearings 25 at both ends, by a predetermined force exerted by compression springs 26 and is therefore rotated by the photosensitive drum 1. At least one of the bearings 25 is composed of electroconductive materials and applies a predetermined charging bias voltage to the charging roller 2, thereby uniformly charging the surface of the photosensitive drum 1.

Further, the photosensitive drum 1 is provided at a predetermined position with a cleaning blade 6, whereby the remaining toner provided with the aforementioned charge of the opposite polarity and present on the intermediate transfer belt is collected on the photosensitive drum 1 and is scraped off from the photosensitive drum together with the toner remaining thereon. The scraped waste toner is prevented from dropping onto the intermediate transfer belt 5*a* by a dip sheet (waste toner counter-flow preventing sheet) 27, and the waste toner accumulated in the bottom of a photosensitive drum frame 29 is conveyed, by the rotation of a screw 28, to the right-hand side when the apparatus is seen from the front side (in the direction indicated by the arrow C in FIG. 4).

Subsequently the waste toner is conveyed by the screw 28 to the right-hand lateral side (when the apparatus is seen from the front side) of the photosensitive drum unit 20, and slides down into and is accumulated in the waste toner containing box 16. The photosensitive drum unit 20 is further provided with a drum shutter 19, which is opened and closed in connection with the mounting and detaching operations of the photosensitive drum unit 20 to the main body of the image forming apparatus.

In the following there will be explained the configuration of the intermediate transfer belt unit 21. The intermediate transfer belt 5*a* is supported, by and between a driving roller 40 and an idler roller 41, in a frame 45 including a handle portion 61.

The driving roller 40 is rotatably supported at both ends thereof by unrepresented bearings, and receives a predetermined rotary driving force from the main body of the apparatus, through a coupling 42 (cf. FIG. 3) at the right-hand end,. Bearings 43 at both ends of the idler roller are provided with compression springs 44 for providing the intermediate transfer belt 5*a* with a predetermined tension.

In a position opposed to the photosensitive drum 1 across the intermediate transfer belt 5*a*, there is provided a primary transfer roller 5*j*, which is pressed under a predetermined force by compression springs 47 through bearings 46 at both ends, and is rotated by the belt.

At least one of the bearings 46 is composed of electroconductive materials and applies a predetermined charging bias voltage to the primary transfer roller 5*j*, thereby causing primary transferring of the toner from the photosensitive drum 1 to the intermediate transfer belt 5*a*.

Also in a position opposed to the intermediate transfer belt driving roller 40, there is provided a cleaning charging roller 23 for providing the remaining toner on the intermediate transfer belt 5*a* with a charge of a polarity opposite to that at the transfer.

The cleaning charging roller 5*f* is pressed to the intermediate transfer belt 5*a* under a predetermined force by compression springs 52 through bearings 51 at both ends, and is rotated by the belt. At least one of the bearings 51 is composed of electroconductive materials and applies a predetermined voltage, opposite in polarity to that at the transfer, to the cleaning charging roller 5*f*, thereby providing the remaining toner on the intermediate transfer belt 5*a* with a charge of an opposite polarity to that at the transfer, whereby the remaining toner is electrostatically attracted to and collected on the surface of the photosensitive drum 1 and is then accumulated in the waste toner containing box 16 as explained in the foregoing.

The above-described configuration provides an image forming unit, integrally containing the intermediate transfer member and the photosensitive drum and comparable in size and cost to the conventional process cartridge integrally containing the developing units and the photosensitive member, or the conventional monochromatic process cartridge, and also allows the main body of the image forming apparatus utilizing such an image forming unit to be compact.

Also, the use of the above-described cleaning charging roller 5*f* unites the waste toner containing boxes for the photosensitive drum and for the intermediate transfer belt, thereby alleviating the limitation in the layout of various components in the unit.

Frame Configuration of Image Forming Unit

In the following there will be given a detailed explanation on the frame configuration of the aforementioned image forming unit. The frame configuration is mainly divided into two parts. As shown in FIG. 4, a first one (a portion surrounded by a thick chain line in FIG. 4) is a photosensitive drum unit composed of a photosensitive drum frame 29, which is integral with the waste toner containing box 16 and on which principally assembled are the photosensitive drum 1, the right-side bearing 80, the left-side bearing 18, the charging roller 2, the cleaning blade 6, the screw 28 and the/drum shutter 19. The second one is an intermediate transfer belt unit 21 composed, as shown in FIG. 2, of an intermediate transfer member frame 45 on which are assembled the intermediate transfer belt 5*a*, the driving and idler rollers 40, 41 for supporting the intermediate transfer belt 5*a*, the primary transfer roller 5*j* positioned inside the intermediate transfer belt so as to be opposed to the photosensitive drum 1, and the cleaning charging roller 5*f* so positioned as to be opposed to the driving roller 40.

In the present embodiment, the service life of the photosensitive member is somewhat shorter than that of the intermediate transfer member, so that the waste toner containing box is provided in the photosensitive member unit.

The above-mentioned two units are mutually connected, as shown in FIGS. 2 and 3, by inserting projections 71, provided on left and right ends of the photosensitive drum frame 29, respectively into positioning holes 72 provided on the intermediate transfer member frame 45, and by fitting a snap fit hook 73, provided at the center in the transversal direction of the photosensitive drum frame 29, into a locking hole 74 of the intermediate transfer member frame 45.

The positioning holes 72 and the locking hole 74 provided on the intermediate transfer member frame 45 are made larger by a predetermined amount than the projections 71 and the snap fit hook 73 provided in the photosensitive drum frame 29, so that a relative positional displacement of a predetermined amount is possible between the photosensitive drum unit 20 and the intermediate transfer belt unit 21. Also the positioning holes 72 are provided with tapered portions 72*a* (cf. FIG. 6) for facilitating attaching and detaching. It is also possible, in order to obtain an appropriate position of the intermediate transfer belt unit 21 relative to the photosensitive drum unit 20 (or an appropriate position of the photosensitive drum unit 20 relative to the intermediate transfer belt unit 21) to render movable at least either of the photosensitive drum unit 20 and the intermediate transfer belt unit 21, in a state where the image forming unit 5 is mounted on the main body A of the image forming apparatus.

Figure 5:
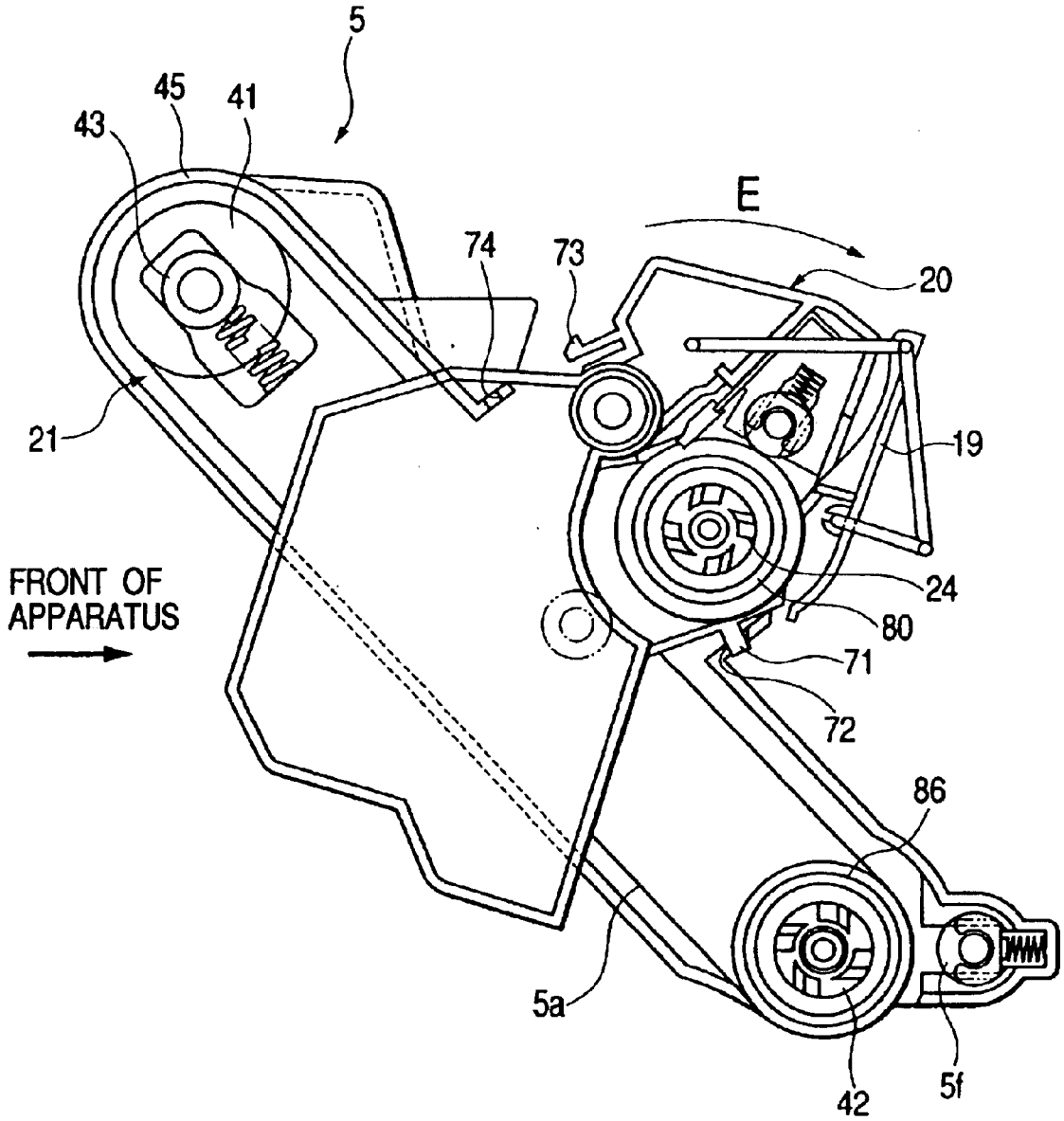
FIG. 5 is a view showing a state of separating a photosensitive drum unit and an intermediate transfer belt unit.
Figure 6:
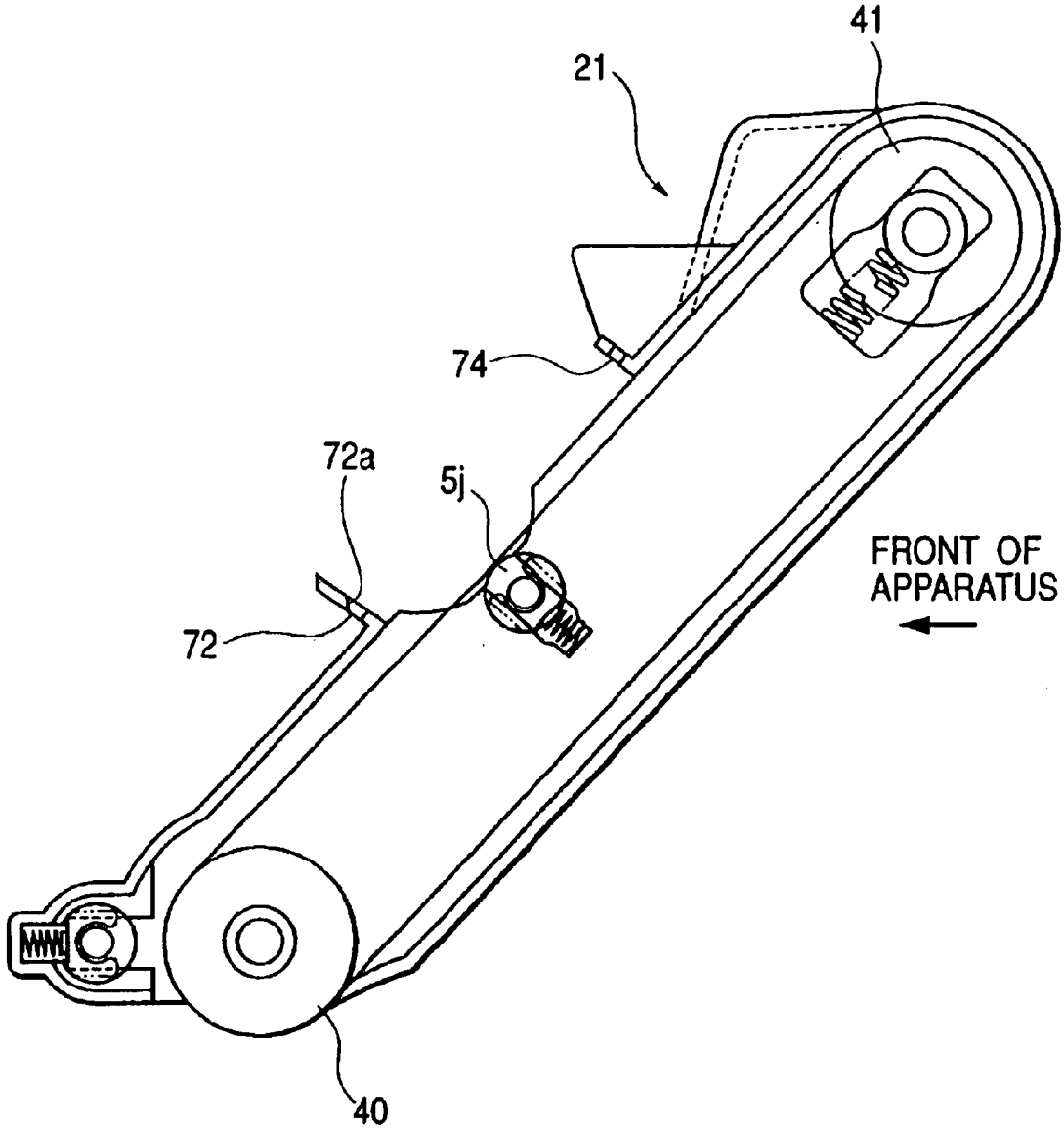
FIG. 6 is a cross-sectional view of the separated intermediate transfer belt unit.
Figure 7:
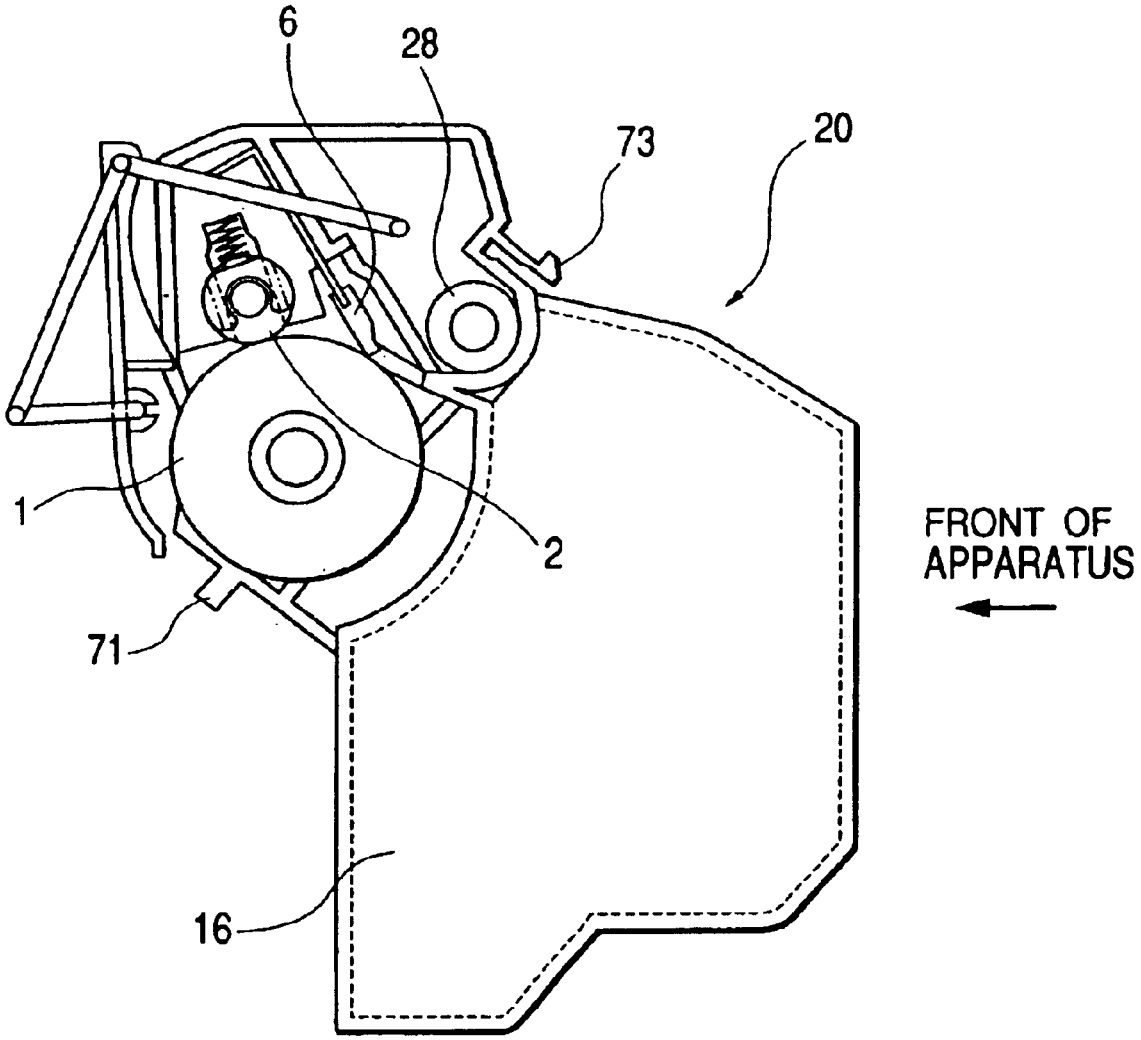
FIG. 7 is a cross-sectional view of the separated photosensitive drum unit.

In the above-described configuration, the image forming unit 5 can be separated into the photosensitive drum unit 20 and the intermediate transfer belt unit 21 as shown in FIGS. 6 and 7, by pressing the hook 73 of the photosensitive drum unit 20 in a direction D thereby detaching the hook 73 from the locking hole 74 of the intermediate transfer belt unit 21 as shown in FIG. 3 and rotating the photosensitive drum unit 20 in a direction E as shown in FIG. 5.

Inversely, the separated units 20, 21 can be connected by inserting the projections 71 of the photosensitive drum unit 20 into the positioning holes 72 of the intermediate transfer belt unit 21 and pressing the hook 73 into the locking hole 74 by a rotation in a direction opposite to the direction E shown in FIG. 5.

Since the photosensitive drum unit 20 and the intermediate transfer belt unit 21 are mutually separable as explained in the foregoing, if the photosensitive drum 1 alone or the intermediate transfer belt 5 alone reaches the end of their service lives, it is possible to only replace such unit reaching the end of its service life. Therefore the cost burden on the user can be alleviated if the photosensitive drum 1 and the intermediate belt 5 have different service lives.

Means for Mounting Unit on the Main Body of Apparatus

In the following there will be explained, with reference to FIG. 8, the configuration for attaching or detaching the aforementioned image forming unit 5 to or from the main body A of the image forming apparatus and positioning and fixing the image forming unit 5.

When an upper cover 60 of the main body A of the color image forming apparatus is opened, a coupling for fitting with a coupling 24 (cf. FIG. 3), provided in a support portion 82 supporting the bearing of the photosensitive drum and transmitting the rotary driving force to the photosensitive drum 1, and a coupling for fitting with a coupling 42 (cf. FIG. 3), provided in a support portion 83 supporting the bearing for the driving shaft of the intermediate transfer belt and transmitting the rotary driving force to the drive roller 40 of the intermediate transfer belt 5*a*, respectively slide in the axial direction to a retracted state (connection released state). The retracting mechanism for the couplings, linked with the upper cover 60, can be composed of a known configuration.

Inside the main body of the apparatus, there are provided a guide rail 84 for the photosensitive drum and a guide rail 85 for the intermediate transfer member, with a step difference γ on each side. This step difference γ corresponds to the step difference γ between the bearings 80, 81 for the drum of the image forming unit 5 and those 86, 87 for the drive roller 40 for the intermediate transfer belt.

The image forming unit 5 is inserted with a sliding motion of the right and left bearings 80, 81 of the photosensitive drum respectively on the guide rails 84 for the photosensitive drum, and the right and left bearings 86, 87 of the drive roller 40 for the intermediate transfer belt and projections 88, 89 provided on the right and left side covers on the guide rails 85 for the intermediate transfer member.

Figure 8:
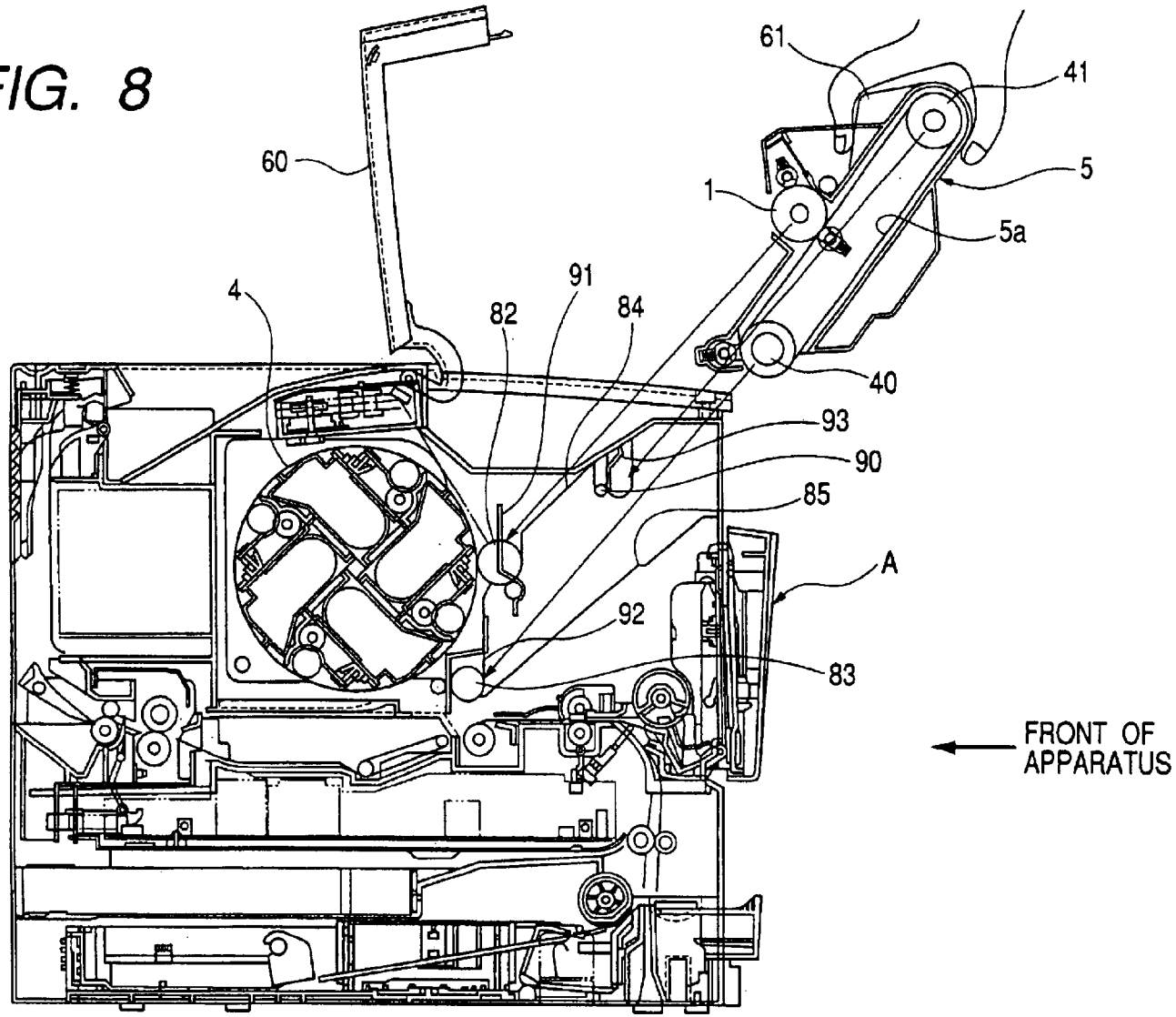
FIG. 8 is a view showing a state of mounting and detaching the image forming unit.

Finally, the right and left bearings 80, 81 of the photosensitive drum fit in support portions 82 for supporting the bearings of the photosensitive drum, while the right and left bearings 86, 87 of the drive roller 40 for the intermediate transfer belt fit in support portions 83 for supporting the bearings of the drive roller for the intermediate transfer belt, and the projections 88, 89 provided on the right and left side covers of the image forming unit fit into positioning grooves 90, whereupon, as shown in FIG. 8, these components are pressed and fixed to positioning portions of the frame of the main body of the apparatus by means of torsion coil springs 91, 92, 93.

The above-described configuration allows the user to easily replace the image forming unit 5, consisting of the photosensitive drum unit 20 and the intermediate transfer belt unit 21, by merely opening the upper cover 60, thereby facilitating the maintenance work such as removing the paper jam or replacing the image forming unit.

Also, since the relative position of the photosensitive drum unit 20 and the intermediate transfer belt unit 21 is movable within a predetermined amount, the photosensitive drum 1 and the intermediate transfer belt 5*a* can be fixed in a normal relative positional relationship and can also be placed in a normal positional relationship to the main body A of the image forming apparatus, even in the presence of a certain dimensional error, when the image forming unit 5 is mounted on the main body of the image forming apparatus. It is thus possible to absorb the dimensional error without employing the conventional configuration with so-called Oldham's coupling for absorbing the misalignment, thereby allowing to simplify the configuration of the couplings for transmitting the rotary driving force to the photosensitive drum 1 and the intermediate transfer belt 5*a*.

In the foregoing embodiment, there has been explained an example in which the image forming unit 5 is formed by connecting the photosensitive drum unit 20 and the intermediate transfer belt unit 21, but it is also possible to integrally fix the photosensitive drum unit 20 to the casing of the unit, thereby forming a unit usable also in the ordinary image forming apparatus, and to detachably attach the intermediate transfer belt unit 21 to such casing of the unit, thereby constituting the image forming unit adapted for use in the image forming apparatus of the present invention. It is also possible, contrary to the foregoing configuration, to integrally fix the intermediate transfer belt unit 21 to the casing of the unit and to detachably attach the photosensitive drum unit 20 to such casing of the unit.

Also in such configurations, it is still possible to replace only the photosensitive drum or the intermediate transfer member reaching the end of their service lives.

According to the present embodiment, in case either of the image bearing member and the intermediate transfer member reaching the end of its service life, it is rendered possible to replace only such member reaching the end of its service life by separating the two units, thereby improving the usability and achieving cost reduction.

Second Embodiment

The present second embodiment is featured in the arrangement of the waste toner containing box and the waste toner conveying unit from the cleaning unit to the waste containing box, but, except for such portions, it is similar in configuration to the image forming apparatus of the foregoing first embodiment.

Figure 9:
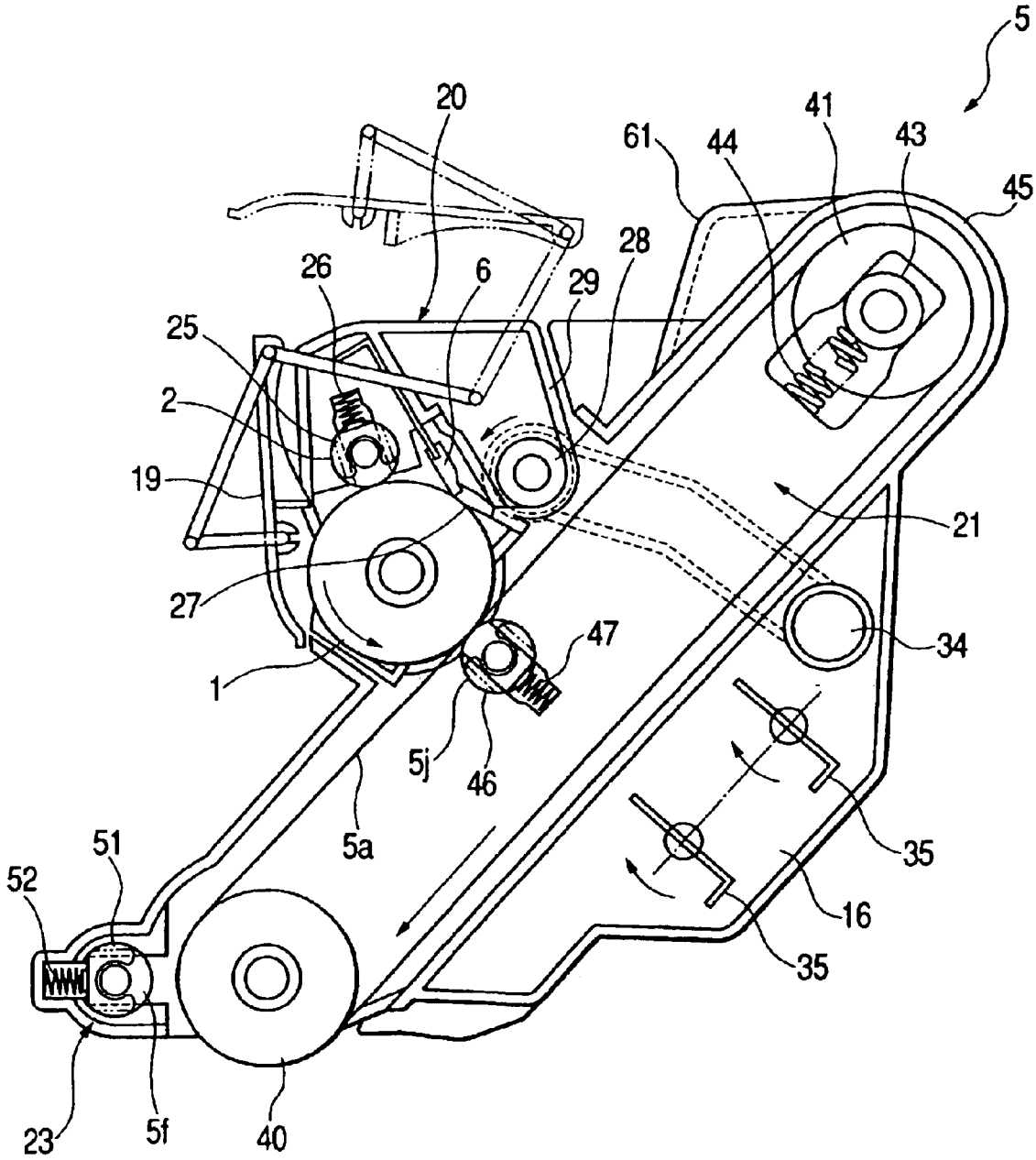
FIG. 9 is a longitudinal cross-sectional view showing the configuration of the image forming unit.
Figure 10:
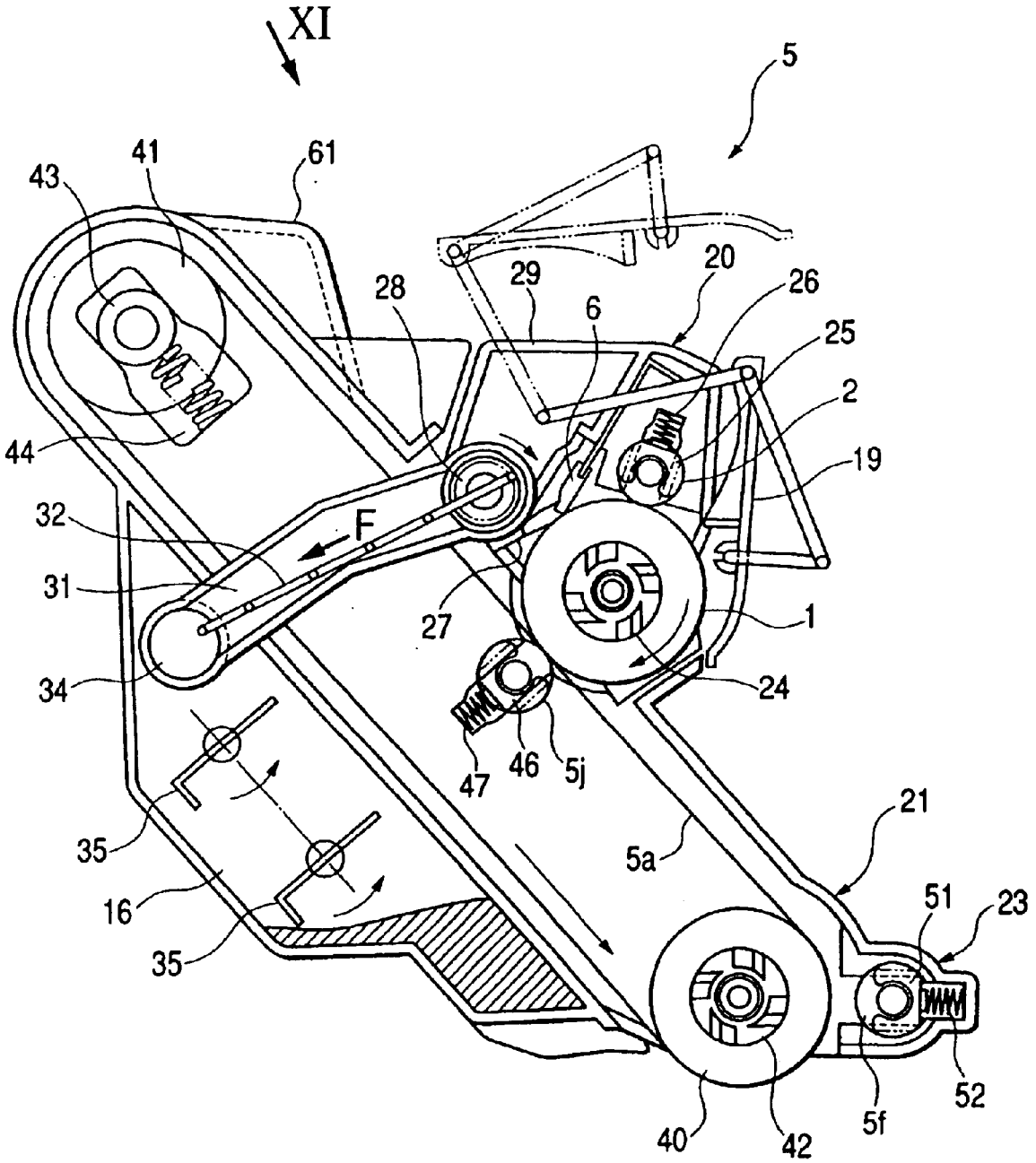
FIG. 10 is a longitudinal cross-sectional view of the image forming unit seen from a direction opposite to that of FIG. 2.
Figure 11:
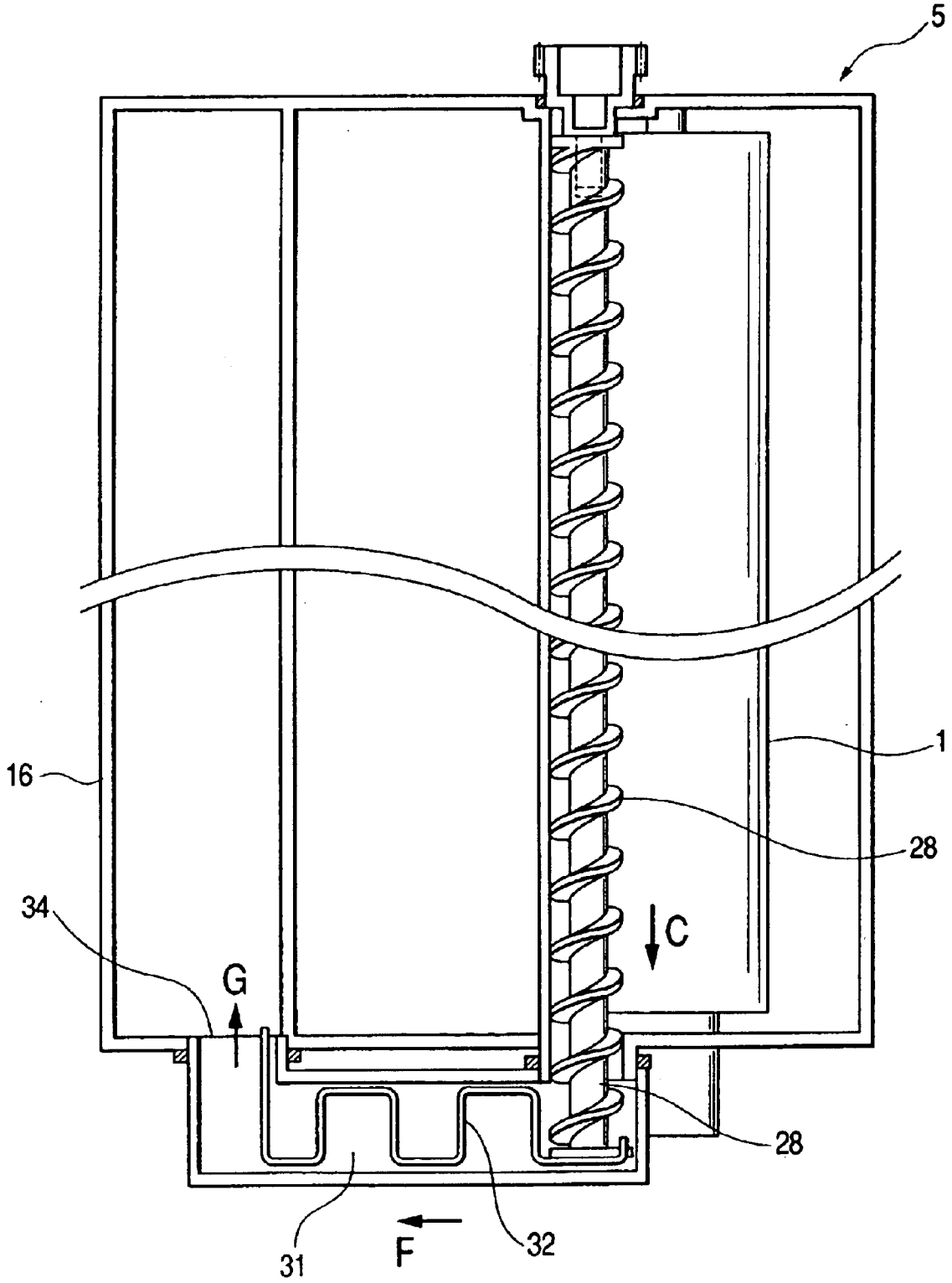
FIG. 11 is a transverse cross-sectional view of a waste toner conveying path, seen from a direction indicated by the arrow XI in FIG. 10.
Figure 12A:
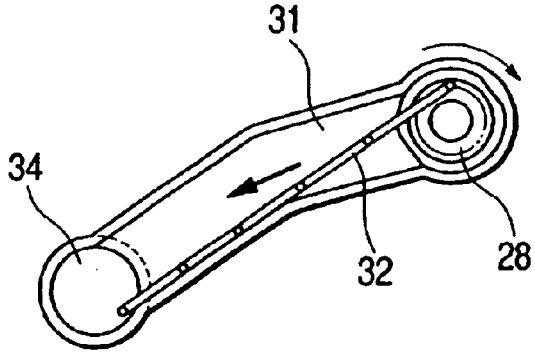
FIGS. 12A, 12B, 12C and 12D are views showing the operation of a wire in the waste toner conveying path.
Figure 12B:
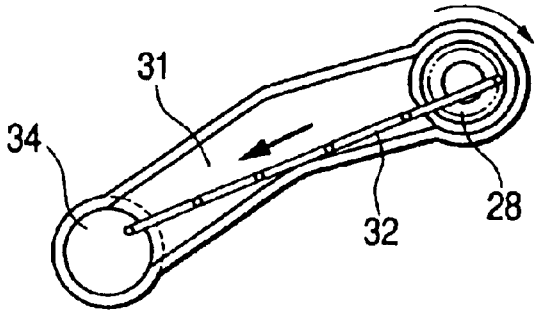
Figure 12C:
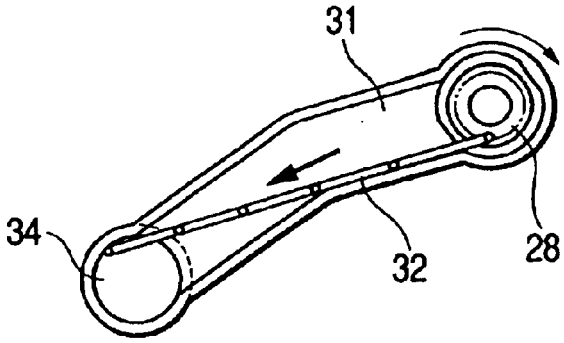
Figure 12D:
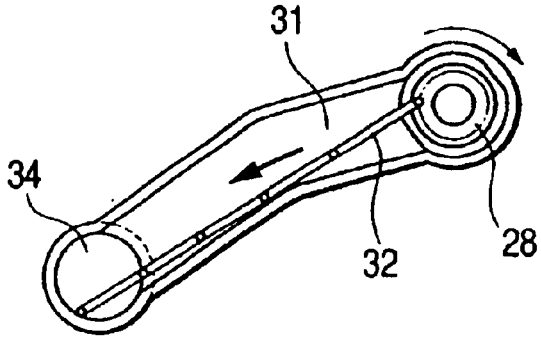

FIG. 9 is a longitudinal cross-sectional view schematically showing the configuration of an image forming unit, while FIG. 10 is a longitudinal cross-sectional view of the image forming unit seen from a direction opposite to that of FIG. 9, and FIG. 11 is a transversal cross-sectional view of a waste toner conveying path seen from a direction XI in FIG. 10.

Referring to FIGS. 9 to 11, an image forming unit includes an intermediate transfer belt 5*a* positioned in an inclined state, a photosensitive drum unit 20 positioned above an intermediate transfer belt unit 21, and a waste toner containing box 16 positioned below the intermediate transfer belt unit 21. Consequently there can be provided an image forming unit 5, capable of making the dimension thereof compact and effectively utilizing the space in the image forming apparatus A. It is also possible to position the conveying path for the recording material below the intermediate transfer belt, so that a duplex unit, including a path for reversing the front and back sides of the recording material for forming images on two sides thereof, can be formed as an optional unit expanded under the image forming apparatus, thereby avoiding an increase in the width of the image forming apparatus.

A belt driving roller 40 of the intermediate transfer belt unit 21 is integrally provided with a cleaning changing roller 23 for providing the remaining toner on the intermediate transfer belt 5*a* with a charge of a polarity opposite to that at the transfer.

In the photosensitive drum unit 20, a photosensitive drum 1 is rotatably supported at both ends thereof by unrepresented bearings, and receives a predetermined rotary driving force from the main body of the apparatus, through a coupling 24 (cf. FIG. 10) at the right-hand end.

To the photosensitive drum 1, a charging roller 2 is pressed, through bearings 25 at both ends, with a predetermined force exerted by compression springs 26 and is therefore rotated by the photosensitive drum 1. At least one of the bearings 25 is composed of electroconductive materials and applies a predetermined charging bias voltage to the charging roller 2, thereby uniformly charging the surface of the photosensitive drum 1.

Further, the photosensitive drum 1 is provided at a predetermined position with a cleaning blade 6 whereby the remaining toner provided with the aforementioned charge of the opposite polarity and present on the intermediate transfer belt 5*a* is collected on the photosensitive drum 1 and is scraped off from the photosensitive drum 1 together with the toner remaining thereon. The scraped waste toner is prevented from dropping onto the intermediate transfer belt 5*a* by means of a dip sheet 27, and the waste toner accumulated in the bottom of a photosensitive drum frame 29 is conveyed, by the rotation of a screw 28, to the right-hand side when the apparatus is seen from the front side (direction C in FIG. 11).

Referring to FIG. 11, the waste toner is conveyed by the screw 28 to the right-hand lateral side (when the apparatus is seen from the front side, namely direction F) of the photosensitive drum unit 20, and slides down a waste toner path 31 (direction G). The waste toner path 31 is provided with means for preventing toner clogging. More specifically, as shown in FIG. 11, there is provided, inside the waste toner path 31, a wire 32 or a rod-shaped member of a form consisting of a continuation of horseshoe shapes, and an end of such wire is rotatably inserted in a portion of the screw 28, out of the center of rotation thereof. The other end of the wire is maintained free and is inserted in a hole 34 communicating with the waste toner path and the waste toner containing box 16.

Thus, when the screw 28 is rotated in a direction indicated by an arrow, the wire 32 rubs, with a rocking motion, the internal wall of the waste toner path 31 bent in a dogleg shape, as shown in FIGS. 12A, 12B, 12C and 12D. In this operation, the horseshoe shape of the wire 32 moves forward and backward in the toner conveying direction, thereby achieving an effect of preventing the toner clogging and stimulating the toner movement. Also in the hole 34 communicating with the waste toner path and the waste toner containing box 16, the end of the wire 34 rotates in contact with the periphery of the hole as shown in FIGS. 12A to 12D, thereby preventing clogging of the toner in the hole 34. It is also possible to adopt a screw 28 whose winding direction is inverted at about the center, thereby conveying the waste toner toward the both ends in the longitudinal direction, to the waste toner containing box 16.

Thereafter the waste toner drops from the hole 34 to the waste toner containing box 16, and is then flattened by an agitating plate 35 and accumulated. Like the screw 28, the agitating plate 35 is rotated in a direction indicated by an arrow, by the rotary driving force transmitted from the main body of the image forming apparatus.

The photosensitive drum unit 20 is further provided with a drum shutter 19, which is opened or closed in connection with the mounting or detaching operation to or from the main body of the image forming apparatus.

In the following there will be explained the configuration of the intermediate transfer belt unit 21. An intermediate transfer belt 5*a* is supported, by and between a driving roller 40 and an idler roller 41, in a frame 45 including a handle portion 61.

The driving roller 40 is rotatably supported at both ends thereof by unrepresented bearings, and receives a predetermined rotary driving force from the main body of the apparatus, through a coupling 42 (cf. FIG. 10) at the right-hand end. Bearings 43 at both ends of the idler roller 41 are provided with compression springs 44 for providing the intermediate transfer belt 5*a* with a predetermined tension.

In a position opposed to the photosensitive drum 1 across the intermediate transfer belt 5*a*, there is provided a primary transfer roller 5*j*, which is pressed under a predetermined force by compression springs 47 through bearings 46 at both ends, and is rotated by the belt.

At least one of the bearings 46 is composed of electroconductive materials and applies a predetermined charging bias voltage to the primary transfer roller 5*j*, thereby primary transferring of the toner from the photosensitive drum 1 to the intermediate transfer belt 5*a*.

Also in a position opposed to the intermediate transfer belt driving roller 40, there is provided a cleaning charging roller 23 for providing the remaining toner on the intermediate transfer belt 5*a* with a charge of a polarity opposite to that at the transfer.

The cleaning charging roller 5*f* is pressed to the intermediate transfer belt 5*a* under a predetermined force by compression springs 52 through bearings 51 at both ends, and is rotated by the belt. At least one of the bearings 51 is composed of electroconductive materials and applies a predetermined voltage, opposite in polarity to that at the transfer, to the cleaning charging roller 5*f*, thereby providing the remaining toner on the intermediate transfer belt 5*a* with a charge of an opposite polarity to that at the transfer, whereby the remaining toner is electrostatically attracted to and collected on the surface of the photosensitive drum 1 and is then accumulated in the waste toner containing box 16 as explained in the foregoing.

The above-described configuration provides an image forming unit, integrally containing the intermediate transfer member and the photosensitive drum and comparable in size and cost to the conventional process cartridge integrally containing the developing units and the photosensitive member, or the conventional monochromatic process cartridge, and also allows the main body of the image forming apparatus utilizing such image forming unit to be compact. Also, the use of the above-described cleaning charging roller 5*f* allows to unite the waste toner containing boxes for the photosensitive drum and for the intermediate transfer belt, thereby alleviating the limitation in the layout of various components in the unit to be compact.

Also, the use of the above-described cleaning charging roller 5*f* allows uniting of the waste toner containing boxes for the photosensitive drum and for the intermediate transfer belt, thereby alleviating the limitation in the layout of various components in the unit.

Configuration for Mounting and Detaching Image Forming Unit

In the following there will be explained operations for mounting or detaching the image forming unit 5 to or from the main body A of the apparatus.

Figure 13:
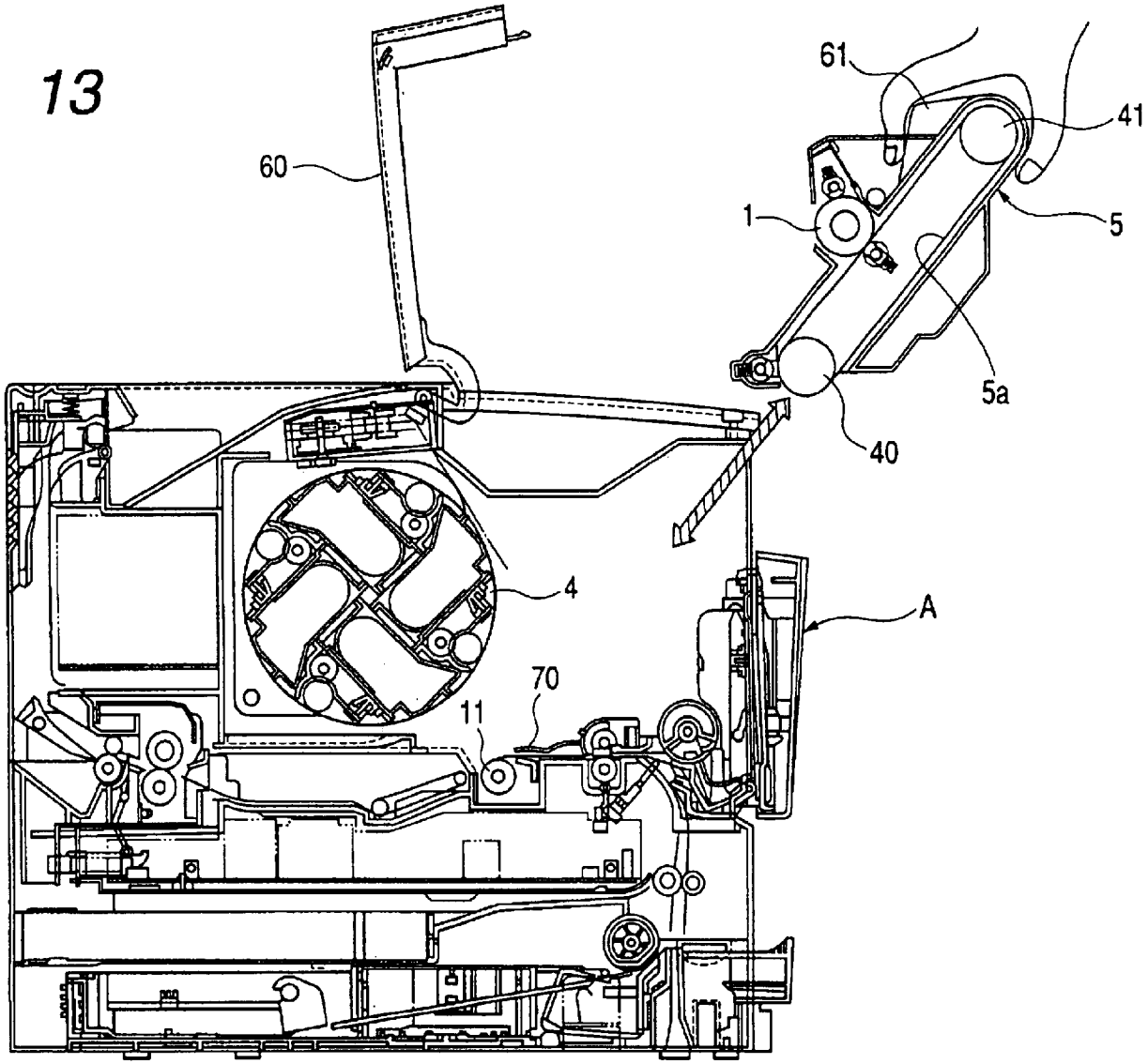
FIG. 13 is a view showing a state of mounting and detaching the image forming unit.
Figure 14:
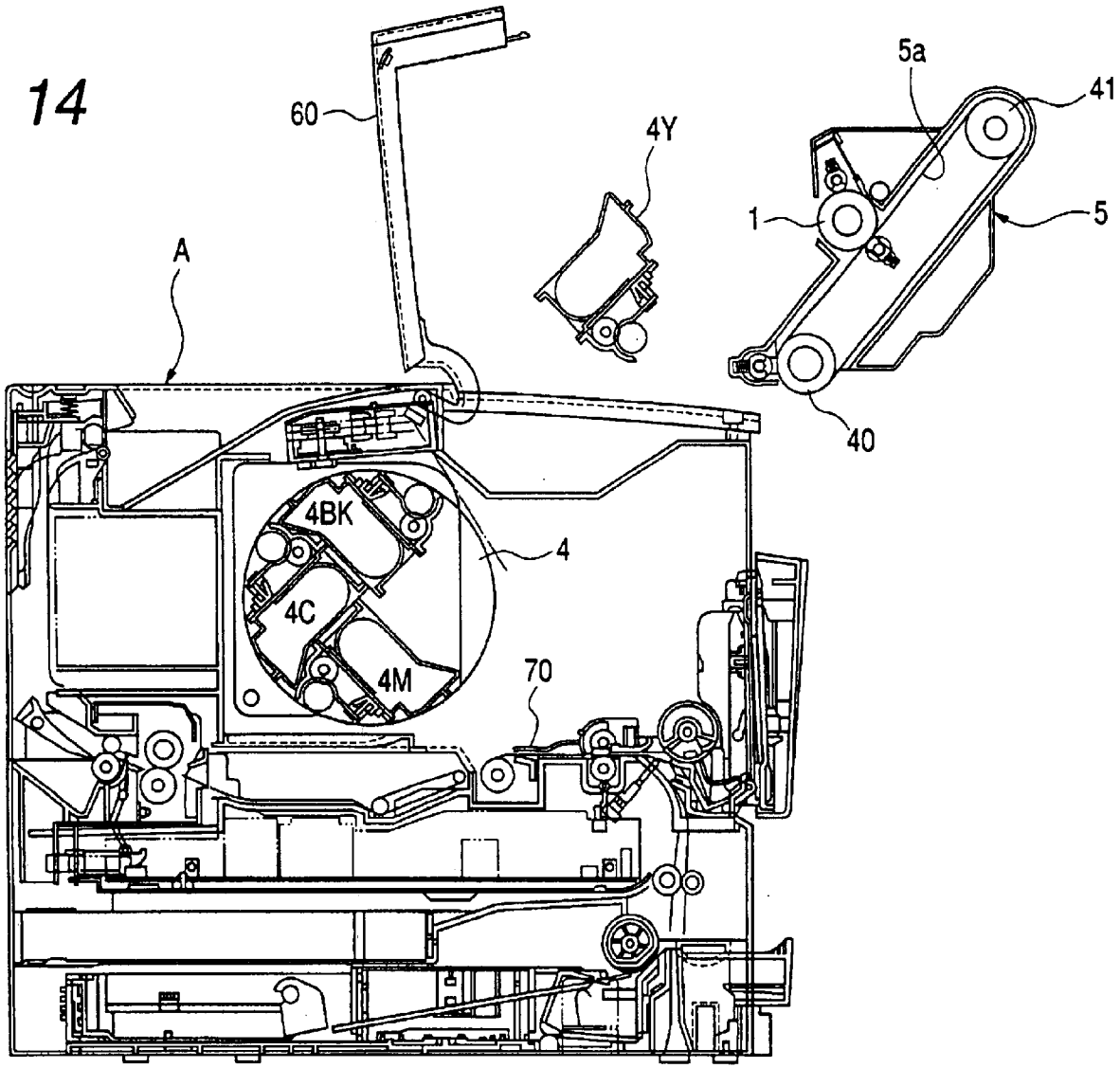
FIG. 14 is a view showing a state of mounting and detaching the image forming unit and a developing device.

The main body A of the apparatus is provided, at the upper part thereof, with an openable upper cover 60 as shown in FIG. 13, and, by opening the upper cover 60, there is exposed a space for mounting the image forming unit, provided in the interior of the main body A. On the lateral walls of such space, there are provided guide members (not shown) for guiding the insertion and extraction of the image forming unit 5.

Therefore the mounting or detaching of the image forming unit 5 can be easily achieved by holding the handle portion 61 and inserting or extracting the image forming unit 5, along the aforementioned guide members, in a downward or upward direction (indicated by an arrow in FIG. 13), substantially perpendicular to the rotary shaft of the photosensitive drum 1.

When the image forming unit 5 is inserted, along the guide members, to a predetermined position, the photosensitive drum 1 and the belt driving roller 40 are positioned and the couplings 24, 42 engage with a driving system of the main body of the apparatus to enable the transmission of the driving force. At the same time, electrical contacts provided on the image forming unit 5 contact the corresponding electrical contacts provided in the main body. Also, in response to the insertion, the drum shutter 19 is automatically opened by a link mechanism, whereby the photosensitive drum 1 is exposed in a position opposed to a developing device 4.

On the other hand, when the image forming unit 5 is detached, a recording material conveying path 70 is exposed in the main body of the apparatus. Consequently, in case the recording material is jammed in the vicinity of the secondary transfer roller 11, such jam can be easily removed by opening the upper cover 60 and detaching the image forming unit 5.

Also by opening the upper cover 60, the developing units 4Y, 4M, 4C, 4BK can be replaced through the aperture serving for mounting or detaching the image forming unit 5. It is therefore not required to form a large aperture on the lateral face of the main body of the apparatus, and the rigidity of the main body can thus be elevated. It is thus rendered possible to suppress the uneven rotation of the photosensitive drum 1.

In the present embodiment there has been explained an image forming unit 5 integrally containing the photosensitive drum 1 and the intermediate transfer belt 5*a*, but the image forming unit may be so constructed that, as in the first embodiment, in a state extracted from the main body of the image forming apparatus, at least either of a photosensitive drum unit including the photosensitive drum 1 and an intermediate transfer member unit including the intermediate transfer belt 5*a* can be detached from or attached to the image forming unit.

Also, since the waste toner containing box is provided below the intermediate transfer member unit, the configuration of the present embodiment in which the photosensitive drum unit and the intermediate transfer belt unit are not detachable from the image forming unit is preferred because there is not required a shutter member or the like for closing the waste toner path when at least either of the photosensitive drum unit and the intermediate transfer belt unit is extracted from the image forming unit.

Arrangement of Power Supply Unit

Figure 15:
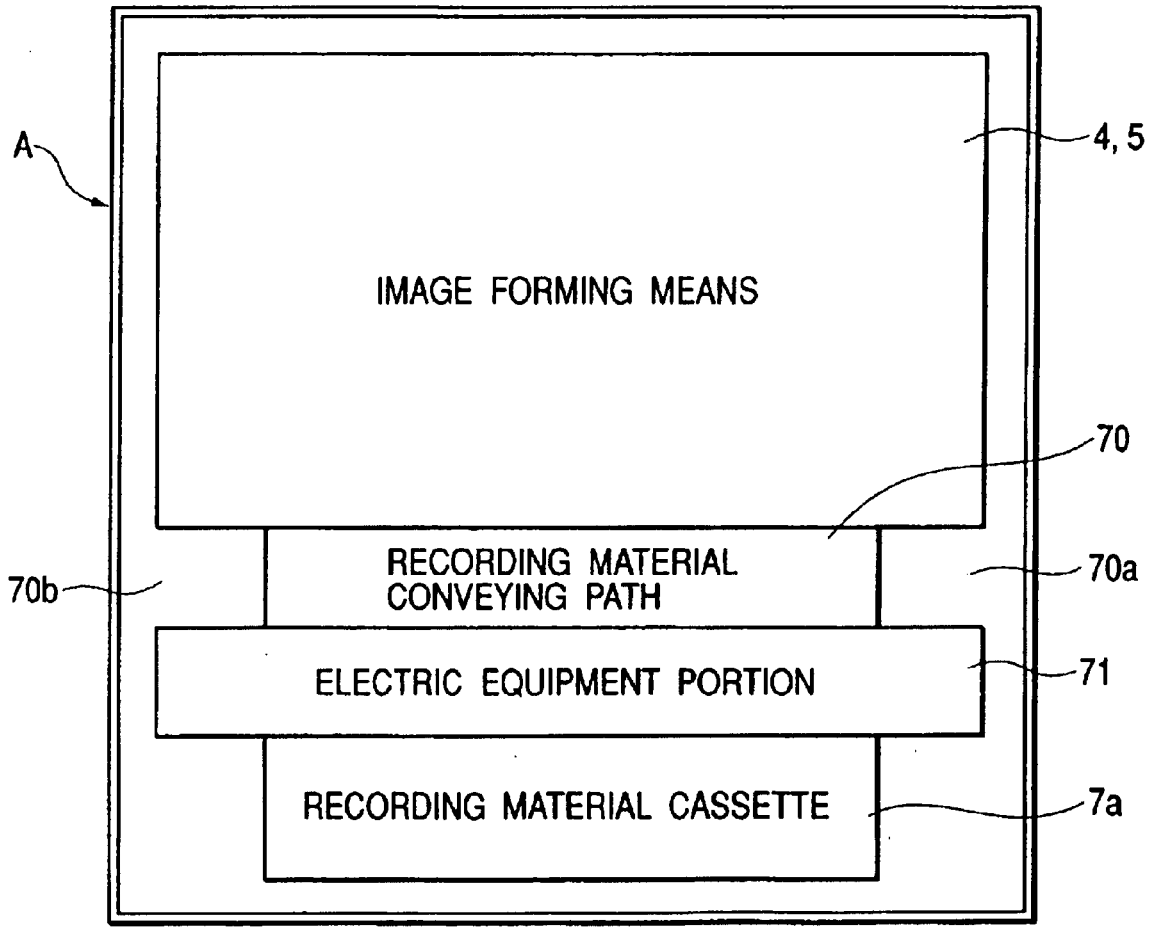
FIG. 15 is a view showing the arrangement of a power supply unit.

In the present embodiment, a power supply unit for supplying the main body A of the apparatus and the image forming unit 5 with an electric power is provided as shown in FIG. 15, which is a longitudinal cross-sectional view of the main body A of the apparatus.

Under the image forming means constituted by the mounting of the aforementioned image forming unit 5, there is provided the recording material conveying path 70, while a recording material cassette 7*a* is mounted on the lowermost part of the apparatus, and an electric equipment portion 71 consisting at least of a low voltage power supply unit and a high voltage power supply unit is provided between the recording material cassette 7*a* and the recording material conveying path 70. The electric supply paths from the electric equipment portion 71 to the image forming unit 5 and the developing apparatus 4 are provided on both sides 70*a*, 70*b* of the recording material conveying path 70. In the present embodiment, a side 70*a* is used for the electric power supply to the photosensitive drum 1 while the other side 70*b* is used for that to the developing apparatus 4.

Such positioning of the electric equipment portion under the recording material conveying path 70 and the use of both sides thereof for the electric power supply paths allow efficient utilization of the space in the apparatus, thereby enabling the apparatus to be compact.

What is claimed is:

1. An image forming unit detachably mountable to a main body of an image forming apparatus, said image forming unit comprising:

a first unit including an image bearing member; and a second unit including an intermediate transfer member to which a toner image on said image bearing member is transferred, wherein the toner image on said intermediate transfer member is transferred to a recording material, wherein said image forming unit is completely separable from the main body in a state in which said first unit and said second unit are connected to each other, and wherein at least either of said first and second units is attachable to and detachable from said image forming unit.

2. An image forming unit according to claim 1, wherein said image forming unit is divisible into said first unit and said second unit.

3. An image forming unit according to claim 1, wherein said first unit includes a charging member configured and positioned to charge said image bearing member.

4. An image forming unit according to claim 1, wherein said first unit includes cleaning means for removing the toner on said image bearing member.

5. An image forming unit according to claim 4, wherein said first unit includes containing means for containing the toner collected by said cleaning means.

6. An image forming unit according to claim 1, wherein said second unit includes charging means for charging the toner on said intermediate transfer member, in order to transfer the toner on said intermediate transfer member to said image bearing member.

7. An image forming unit according to claim 6, wherein the toner image on said image bearing member is transferred to said intermediate transfer member simultaneous with the transfer of the toner charged by said charging means from said intermediate transfer member to said image bearing member.

8. An image forming unit according to claim 1, wherein, in a state in which said image forming unit is mounted to the main body of the image forming apparatus, at least either of said first and second units is movable.

9. An image forming apparatus comprising:

an image forming unit detachably mountable to a main body of said image forming apparatus, wherein said image forming unit comprises:

a first unit including an image bearing member; and a second unit including an intermediate transfer member to which a toner image on said image bearing member is transferred, wherein the toner image on said intermediate transfer member is transferred to a recording material, wherein said image forming unit is completely detachable from said main body, wherein said first unit and said second unit are connected to each other during complete detachment of said image forming unit from said main body, and wherein at least either of said first and second units is attachable to and detachable from said image forming unit.

10. An image forming apparatus according to claim 9, wherein said image forming unit is divisible into said first unit and said second unit.

11. An image forming apparatus according to claim 9, wherein said first unit includes a charging member configured and positioned to charge said image bearing member.

12. An image forming apparatus according to claim 9, wherein said first unit includes cleaning means for removing the toner on said image bearing member.

13. An image forming apparatus according to claim 12, wherein said first unit includes containing means for containing the toner collected by said cleaning means.

14. An image forming apparatus according to claim 9, wherein said second unit includes charging means for charging the toner on said intermediate transfer member, in order to transfer the toner on said intermediate transfer member to said image bearing member.

15. An image forming apparatus according to claim 14, wherein the toner image on said image bearing member is transferred to said intermediate transfer member simultaneous with the transfer of the toner charged by said charging means from said intermediate transfer member to said image bearing member.

16. An image forming apparatus according to claim 9, wherein, in a state in which said image forming unit is mounted to said main body of said image forming apparatus, at least either of said first and second units is movable.

17. An image forming unit detachably mountable to a main body of an image forming apparatus, said image forming unit comprising:

a first unit including an image bearing member; and a second unit including an intermediate transfer member to which a toner image on said image bearing member is transferred, wherein the toner image on said intermediate transfer member is transferred to a recording material, wherein said image forming unit is completely separable from the main body in a state in which said first unit and said second unit are connected to each other, and wherein said first unit and said second unit are movable relative to each other in said image forming unit.

18. An image forming unit according to claim 17, wherein said image forming unit is mounted on the main body to thereby determine positions of said first unit and said second unit with respect to the main body.

19. An image forming unit according to claim 18, wherein said image forming unit includes a fixed projection, a drive bearing of said image bearing member, and a drive bearing of said intermediate transfer member, and wherein said image forming unit is positioned in the main body by said fixed projection, said drive bearing of said image bearing member, and said drive bearing of said intermediate transfer member.

20. An image forming unit according to claim 17, wherein said first unit includes a charging member configured and positioned to charge said image bearing member.

21. An image forming unit according to claim 17, wherein said first unit includes cleaning means for removing the toner on said image bearing member.

22. An image forming unit according to claim 21, wherein said first unit includes containing means for containing the toner collected by said cleaning means.

23. An image forming unit according to claim 17, wherein said second unit includes charging means for charging the toner on said intermediate transfer member, in order to transfer the toner on said intermediate transfer member to said image bearing member.

24. An image forming unit according to claim 23, wherein the toner image on said image bearing member is transferred to said intermediate transfer member simultaneous with the transfer of the toner charged by said charging means from said intermediate transfer member to said image bearing member.

25. An image forming apparatus comprising:

an image forming unit detachably mountable to a main body of said image forming apparatus, wherein said image forming unit comprises:

a first unit including an image bearing member; and a second unit including an intermediate transfer member to which a toner image on said image bearing member is transferred, wherein the toner image on said intermediate transfer member is transferred to a recording material, wherein said image forming unit is completely separable from the main body in a state in which said first unit and said second unit are connected to each other, and wherein said first unit and said second unit are movable relative to each other in said image forming unit.

26. An image forming apparatus according to claim 25, wherein said image forming unit is mounted on the main body to thereby determine positions of said first unit and said second unit with respect to the main body.

27. An image forming apparatus according to claim 26, wherein said image forming unit includes a fixed projection, a drive bearing of said image bearing member, and a drive bearing of said intermediate transfer member, and wherein said image forming unit is positioned in the main body by said fixed projection, said drive bearing of said image bearing member, and said drive bearing of said intermediate transfer member.

28. An image forming apparatus according to claim 25, wherein said first unit includes a charging member configured and positioned to charge said image bearing member.

29. An image forming apparatus according to claim 25, wherein said first unit includes cleaning means for removing the toner on said image bearing member.

30. An image forming apparatus according to claim 29, wherein said first unit includes containing means for containing the toner collected by said cleaning means.

31. An image forming apparatus according to claim 25, wherein said second unit includes charging means for charging the toner on said intermediate transfer member, in order to transfer the toner on said intermediate transfer member to said image bearing member.

32. An image forming apparatus according to claim 31, wherein the toner image on said image bearing member is transferred to said intermediate transfer member simultaneous with the transfer of the toner charged by said charging means from said intermediate transfer member to said image bearing member.

33. An image forming unit detachably mountable to a main body of an image forming apparatus, said image forming unit comprising:

a first unit including an image bearing member;

a second unit including an intermediate transfer member to which a toner image on said image bearing member is transferred at a transfer portion; and charging means for charging toner on said intermediate transfer member at a position different from said transfer portion, wherein the toner image on said intermediate transfer member is transferred to a recording material, and wherein said image forming unit is completely separable from the main body in a state in which said first unit and said second unit are connected to each other.

34. An image forming unit according to claim 33, wherein the toner charged by said charging means is transferred from said intermediate transfer member to said image bearing member.

35. An image forming unit according to claim 34, wherein the toner image on said image bearing member is transferred to said intermediate transfer member simultaneous with the transfer of the toner charged by said charging means from said intermediate transfer member to said image bearing member.

36. An image forming apparatus comprising:

an image forming unit detachably mountable to a main body of said image forming apparatus;

wherein said image forming unit comprises:

a first unit including an image bearing member;

a second unit including an intermediate transfer member to which a toner image on said image bearing member is transferred at a transfer portion; and charging means for charging toner on said intermediate transfer member at a position different from said transfer portion, wherein the toner image on said intermediate transfer member is transferred to a recording material, and wherein said image forming unit is completely detachable from said main body, wherein said first unit and said second unit are connected to each other during complete detachment of said image forming unit from said main body.

37. An image forming apparatus according to claim 36, wherein the toner charged by said charging means is transferred from said intermediate transfer member to said image bearing member.

38. An image forming apparatus according to claim 37, wherein the toner image on said image bearing member is transferred to said intermediate transfer member simultaneous with the transfer of the toner charged by said charging means from said intermediate transfer member to said image bearing member.

39. An image forming unit detachably mountable to a main body of an image forming apparatus, said image forming unit comprising:

a first unit including a photosensitive drum; and a second unit including an intermediate transfer belt to which a toner image on said photosensitive drum is transferred, wherein the toner image on said intermediate transfer belt is transferred to a recording material, and wherein said image forming unit is completely separable from the main body in a state in which said first unit and said second unit are connected to each other.

40. An image forming unit according to claim 39, wherein at least either of said first and second units is attachable to and detachable from said image forming unit.

41. An image forming unit according to claim 39, wherein said first unit and said second unit are movable relative to each other in said image forming unit.

42. An image forming unit according to claim 39, further comprising charging means for charging toner on said intermediate transfer belt at a position different from a transfer portion at which the toner image on said photosensitive drum is transferred to said intermediate transfer belt.

43. An image forming apparatus comprising:

an image forming unit detachably mountable to a main body of said image forming apparatus, wherein said image forming unit comprises a first unit including a photosensitive drum, and a second unit including an intermediate transfer belt to which a toner image on said photosensitive drum is transferred, wherein the toner image on said intermediate transfer belt is transferred to a recording material, and wherein said image forming unit is completely detachable from said main body, wherein said first unit and said second unit are connected to each other during complete detechment of said image forming unit from said main body.

44. An image forming apparatus according to claim 43, wherein at least either of said first and second units are attachable to and detachable from said image forming unit.

45. An image farming apparatus according to claim 43, wherein said first unit and said second unit are movable relative to each other in said image forming unit.

46. An image forming apparatus according to claim 43, wherein said image forming unit further comprises charging means for charging toner on said intermediate transfer belt at a position different from a transfer portion at which the toner image on said photosensitive drum is transferred to said intermediate transfer belt.

* * * * *

UNITED STATES PATENT AND TRADEMARK OFFICE

CERTIFICATE OF CORRECTION

PATENT NO. : 6,807,393 B2
DATED : October 19, 2004
INVENTOR(S) : Takao Sameshima et al.

It is certified that error appears in the above-identified patent and that said Letters Patent is hereby corrected as shown below:

Column 4,
Line 2, “respective” should read -- the respective --.

Column 16,
Line 56, “farming” should read -- forming --.

Signed and Sealed this

Nineteenth Day of April, 2005

JON W. DUDAS
*Director of the United States Patent and Trademark Office*